US007025590B2

(12) United States Patent
Bussman et al.

(10) Patent No.: US 7,025,590 B2
(45) Date of Patent: Apr. 11, 2006

(54) REMOTE STAGED RADIANT WALL FURNACE BURNER CONFIGURATIONS AND METHODS

(75) Inventors: Wesley R. Bussman, Tulsa, OK (US); Richard T. Waibel, Broken Arrow, OK (US); Charles E. Baukal, Jr., Tulsa, OK (US); Roberto Ruiz, Tulsa, OK (US); I-Ping Chung, Tulsa, OK (US); Sellamuthu G. Chellappan, Houston, TX (US)

(73) Assignee: John Zink Company, LLC, Tulsa, OK (US)

( * ) Notice: Subject to any disclaimer, the term of this patent is extended or adjusted under 35 U.S.C. 154(b) by 0 days.

(21) Appl. No.: 10/758,642

(22) Filed: Jan. 15, 2004

(65) Prior Publication Data

US 2005/0158681 A1 Jul. 21, 2005

(51) Int. Cl.
*F23D 14/12* (2006.01)

(52) U.S. Cl. ..... 431/348

(58) Field of Classification Search ..... 431/8–10, 431/174–180, 348–353
See application file for complete search history.

(56) References Cited

U.S. PATENT DOCUMENTS

| | | | | |
|---|---|---|---|---|
| 4,652,232 | A | | 3/1987 | Schwartz et al. |
| 4,661,685 | A | | 4/1987 | Contri |
| D289,600 | S | | 5/1987 | Thomas |
| D289,963 | S | | 5/1987 | Thomas |
| 4,663,849 | A | | 5/1987 | Nickelson |
| 4,664,617 | A | | 5/1987 | Schwartz et al. |
| D290,215 | S | | 6/1987 | Sonnentag et al. |
| D290,218 | S | | 6/1987 | Thomas |
| 4,673,798 | A | | 6/1987 | Contri et al. |
| D290,889 | S | | 7/1987 | Steinkamp |
| 4,683,369 | A | | 7/1987 | Reickman et al. |
| 4,686,352 | A | | 8/1987 | Nawrot et al. |
| 4,702,691 | A | | 10/1987 | Ogden |
| 4,737,100 | A | | 4/1988 | Schnell et al. |
| 4,781,578 | A | | 11/1988 | Napier |
| 4,788,918 | A | | 12/1988 | Keller |
| 4,798,150 | A | | 1/1989 | Pressnall et al. |
| 4,838,184 | A | | 6/1989 | Young et al. |
| 4,870,910 | A | | 10/1989 | Wright et al. |
| 4,900,244 | A | | 2/1990 | Keller et al. |
| 4,901,652 | A | | 2/1990 | Pressnall et al. |
| 4,902,484 | A | | 2/1990 | Martin et al. |
| 4,922,838 | A | | 5/1990 | Keller et al. |
| 4,952,137 | A | | 8/1990 | Schwartz et al. |
| 4,975,042 | A | | 12/1990 | Schwartz et al. |
| 5,098,282 | A | | 3/1992 | Schwartz et al. |
| 5,154,596 | A | | 10/1992 | Schwartz et al. |
| 5,154,735 | A | | 10/1992 | Dinsmore et al. |
| 5,180,302 | A | | 1/1993 | Schwartz et al. |
| 5,195,844 | A | | 3/1993 | Goans |
| 5,238,395 | A | | 8/1993 | Schwartz et al. |
| 5,275,552 | A | | 1/1994 | Schwartz et al. |
| 5,345,771 | A | | 9/1994 | Dinsmore |
| 5,688,115 | A | * | 11/1997 | Johnson ..... 431/9 |
| 5,718,573 | A | * | 2/1998 | Knight et al. ..... 431/354 |

(Continued)

*Primary Examiner*—S. Gravini
(74) *Attorney, Agent, or Firm*—McAfee & Taft

(57) ABSTRACT

A remote staged radiant wall furnace burner configuration includes placement of secondary fuel gas nozzles remote from radiant wall burners. This configuration brings about an increased mixing of secondary fuel with furnace flue gases. As a result, the temperature of the burning fuel gas is lowered and $NO_X$ formation is reduced.

28 Claims, 10 Drawing Sheets

U.S. PATENT DOCUMENTS 5,813,849 A 9/1998 Schwartz et al.
5,846,068 A 12/1998 Schwartz et al.
5,951,741 A 9/1999 Dahl et al.
6,000,930 A 12/1999 Kelly et al.
6,062,848 A * 5/2000 Lifshits ..... 431/285
6,231,334 B1 5/2001 Bussman et al.
6,347,935 B1 2/2002 Schindler et al.
6,379,146 B1 4/2002 Zink et al.
6,383,461 B1 5/2002 Lang
6,383,462 B1 5/2002 Lang
6,422,858 B1 7/2002 Chung et al.
6,464,491 B1 10/2002 Guarco et al.
6,478,239 B1 11/2002 Chung et al.
6,486,375 B1 11/2002 Lenhart et al.
6,524,098 B1 2/2003 Tsirulnikov et al.
6,565,361 B1 5/2003 Jones et al.
6,607,376 B1 8/2003 Poe
6,616,442 B1 9/2003 Venizelos et al.
6,632,083 B1 10/2003 Bussman et al.
6,634,881 B1 10/2003 Bussman et al.
2002/0076668 A1 6/2002 Venizelos et al.
2003/0170579 A1 * 9/2003 Wang et al. ..... 431/174

* cited by examiner

REMOTE STAGED RADIANT WALL FURNACE BURNER CONFIGURATIONS AND METHODS

BACKGROUND OF THE INVENTION

1. Field of the Invention

The present invention relates to remote staged radiant wall furnace burner configurations, and more particularly, to the placement of secondary gas nozzles remote from the radiant wall burner nozzles resulting in lower $NO_X$ production.

2. Description of the Prior Art

Radiant wall gas burner furnaces are well known and have been used in reforming and cracking operations and the like for many years. Radiant wall burners generally include central fuel gas-air mixture burner tubes surrounded by annular refractory tiles which are adapted for insertion into openings in the furnace wall. The burner nozzles discharge fuel gas-air mixtures in directions generally parallel and adjacent to the internal faces of the refractory tiles. The combustion of the fuel gas-air mixtures causes the faces of the burner tiles to radiate heat, e.g., to process tubes, and undesirable flame impingement on the process tubes is thereby avoided.

Radiant wall burners are typically installed in several rows along a furnace wall. This type of configuration is usually designed to provide uniform heat input to the process from the wall area comprising the radiant wall burner matrix.

More stringent environmental emission standards are continuously being imposed by governmental authorities which limit the quantities of gaseous pollutants such as oxides of nitrogen ($NO_X$). Such standards have led to the development of staged or secondary fuel burner apparatus and methods wherein all of the air and some of the fuel is burned in a first zone and the remaining fuel is burned in a second downstream zone. In such staged fuel burner apparatus and methods, an excess of air in the first zone functions as a diluent which lowers the temperature of the burning gases and thereby reduces the formation of $NO_X$. Desirably, furnace flue gas functions as a diluent to lower the temperature of the burning secondary fuel and thereby reduces the formation of $NO_X$.

Similarly, staged radiant wall burner designs have also been developed wherein the burners radially combust a primary fuel lean mixture of fuel gas and air and stage fuel risers supply the stage tips with secondary fuel. The location of the secondary fuel tips can vary, depending on the manufacturer and type of burner, but they are typically located either in the center of the burner tip or around and adjacent to the perimeter of the tip.

While the staged radiant wall burners and furnace designs have been improved whereby combustion gases containing lower levels of pollutants are produced, additional improvement is necessary. Thus, there is a need for improved methods of burning fuel gas and air using radiant wall burners whereby combustion gases having lower pollutant levels are produced.

SUMMARY OF THE INVENTION

A radiant wall furnace burner configuration is provided utilizing rows of multiple radiant wall burners that burn fuel-gas air mixtures inserted in a wall of the furnace with a regular spacing. In accordance with this invention, one or more arrays of secondary fuel gas nozzles are also provided located separate and remote from the radiant wall burners. Secondary fuel gas is introduced into the fuel gas nozzles in an amount that constitutes a substantial portion of the total fuel provided to the combustion zone by the fuel gas-air mixtures and the secondary fuel gas. Preferably the secondary fuel gas nozzles are positioned on the furnace wall adjacent to the rows of radiant wall burners or on the furnace floor, or both, and direct secondary fuel gas to various locations including a location on the opposite side of the combustion zone from the radiant wall burners. As a result, $NO_X$ levels in the combustion gases leaving the furnace are substantially reduced.

In a preferred arrangement, the furnace wall is at least substantially vertical and the radiant wall burners are approximately parallel and approximately evenly spaced in rows and columns, and the secondary fuel gas nozzles are positioned in a single row with each nozzle positioned directly below a radiant wall burner in the row above. In another preferred configuration, the radiant wall burners are approximately parallel with the burners approximately evenly spaced in rows and columns, and the secondary fuel gas nozzles are positioned below the radiant wall burners in an upper row and a lower row, wherein each nozzle of the upper row is directly below a burner in the row above and wherein each nozzle of the lower row is midway between the horizontal positions of the nozzles directly above it. In yet another preferred configuration, the radiant wall burners are offset halfway from one another in a staggered positioning, and the secondary fuel gas nozzles are positioned in a single or double row directly below the radiant wall burners with each nozzle positioned to continue the staggered positioning. In still another configuration, a first row of secondary fuel gas nozzles is located below all the radiant wall burners and a second row of secondary gas nozzles is located about midway up the rows of radiant wall burners.

In other preferred arrangements, secondary fuel gas nozzles are also located on the furnace floor, and the furnace can include floor burners (also referred to as hearth burners) with or without secondary fuel gas nozzles on the floor.

Preferably, the secondary fuel gas nozzles have tips with at least one fuel delivery orifice designed to eject fuel gas at an upward angle relative to the longitudinal axis of the nozzle. More preferably, the secondary fuel gas nozzles have multiple fuel delivery orifices.

The present invention also provides a method for burning fuel in a radiant wall combustion furnace comprising: (a) providing a fuel lean mixture of fuel gas and air to individual radiant wall burners arranged in rows along a wall of the furnace; (b) causing the mixture to flow radially outward from each radiant wall burner across the wall of the furnace whereby the mixture contains excess air and is burned at a relatively low temperature and flue gases having low $NO_X$ content are formed therefrom; and (c) providing secondary fuel gas to remote and separate secondary fuel gas nozzles located whereby the secondary fuel mixes with flue gases in the furnace and combusts with excess air from the radiant wall burners, lowers the temperature of the burning fuel gas and reduces the formation of $NO_X$.

Other features and advantages of the present invention will be readily apparent to those skilled in the art upon a reading of the description of preferred embodiments which follows when taken in conjunction with the accompanying drawings.

BRIEF DESCRIPTION OF THE DRAWINGS

FIG. 8 is a graph comparing $NO_X$ emissions from a test furnace with and without the remote staging technique of this invention.

DESCRIPTION OF PREFERRED EMBODIMENTS

A preferred radiant wall furnace burner configuration of this invention utilizes rows of multiple radiant wall burners that include annular refractory tiles and burn fuel gas lean fuel gas-air mixtures connected to a wall of the furnace in a regular spacing and an array of secondary fuel gas nozzles located separate and remote from the radiant wall burners with means for introducing secondary fuel gas into the secondary fuel gas nozzles and wherein the secondary fuel gas constitutes a substantial portion of the total fuel provided to the combustion zone by the fuel gas-air mixtures and the secondary fuel gas. Preferably, the secondary fuel gas nozzles are positioned on the furnace wall adjacent to the rows of radiant wall burners or on the furnace floor, or both, and direct secondary fuel gas to various locations including a location on the opposite side of the combustion zone from the radiant wall burners. As a result, $NO_X$ levels in the combustion gases leaving the furnace are reduced.

Figure 1:
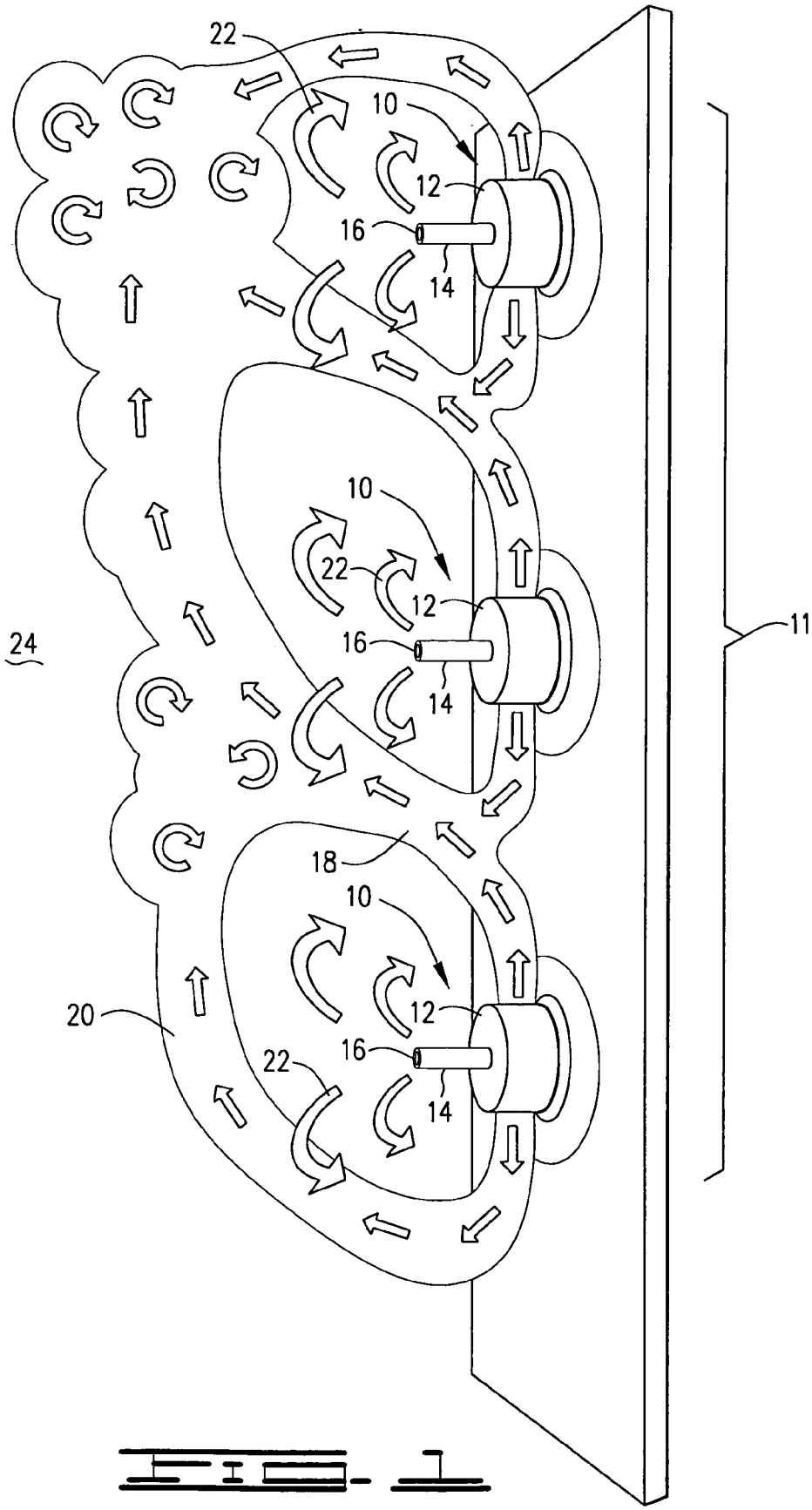
FIG. 1 illustrates the gas flow pattern using conventional staging with secondary fuel gas in the center of each burner.

Referring now to the drawings, FIG. 1 depicts a traditional burner column 11 of staged fuel radiant wall burners 10. The staged fuel radiant wall burners 10 consist of radiant wall burner tips 12 which are provided with a fuel gas lean mixture of primary fuel gas and air. Secondary fuel gas risers 14 supply the secondary fuel gas tips 16 thereof with fuel gas. The location of the secondary fuel gas tips 16 is typically in the centers of the radiant wall burner tips 12 as shown in FIG. 1, or around the perimeters of the radiant wall burner tips 12. As shown in FIG. 1, the fuel gas-air streams exiting the burner tips 12 form barriers 18 and 20 and encapsulate or surround the secondary fuel gas 22. The fuel gas-air barriers 18 and 20 around the secondary fuel gas 22 prevents sufficient entrainment of flue gas 24 resulting in increased $NO_X$ emissions.

Figure 2:
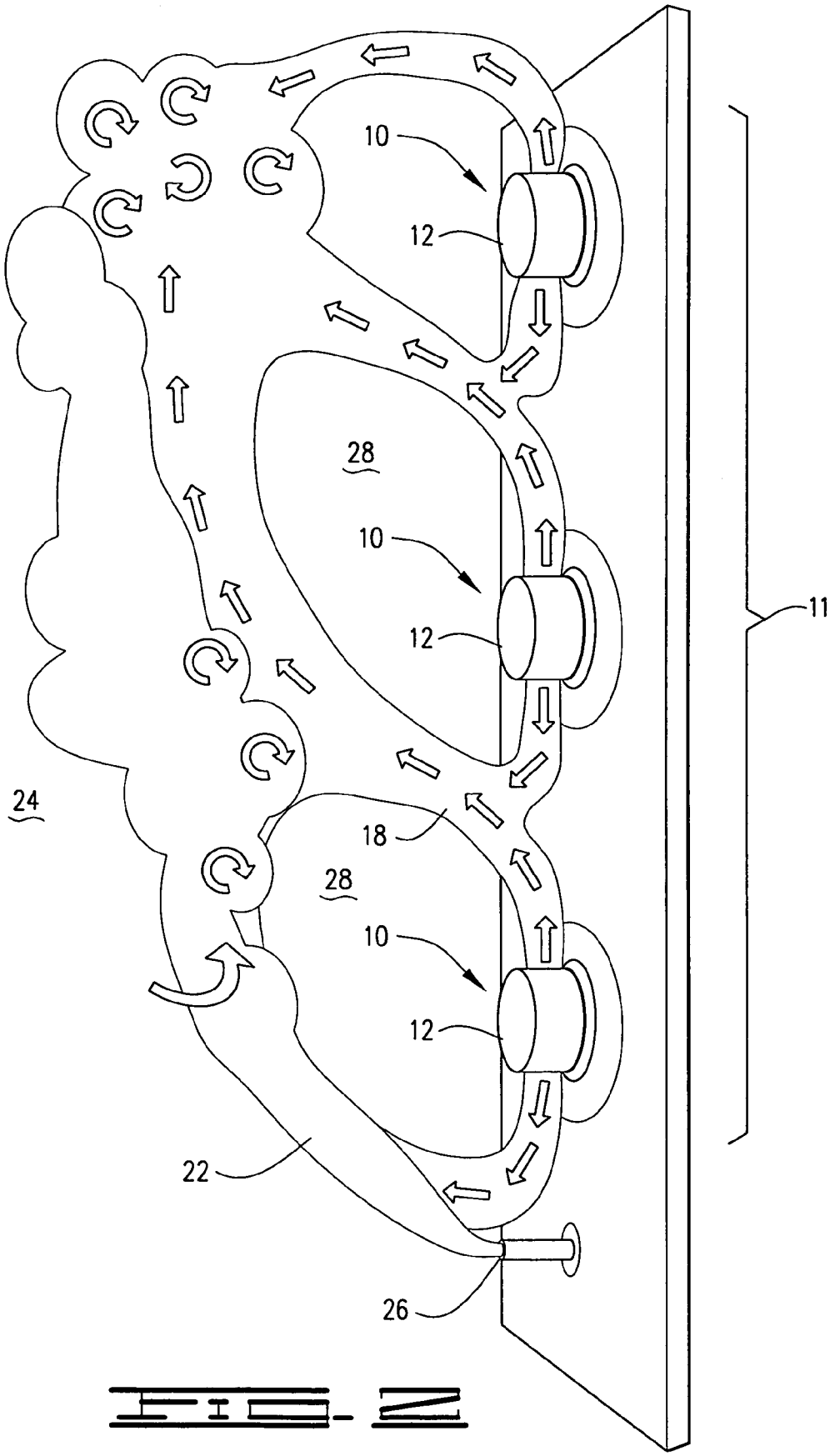
FIG. 2 illustrates the gas flow pattern of the present invention with remote staging of fuel gas.

In the remote staged fuel technique of the present invention, the secondary fuel gas from or adjacent each radiant wall burner 10 is eliminated. Instead, the secondary fuel gas is injected into the furnace at a remote location. As shown in FIG. 2, by moving the secondary fuel gas to a remote secondary fuel gas nozzle 26 located, for example, below the burner column 11, the secondary fuel gas 22 is able to mix with the furnace flue gases 24 prior to mixing with the fuel gas-air mixture 18 in the combustion zone 28. It has been found that by using one or more remote secondary fuel gas nozzles 26 positioned at remote locations and providing secondary fuel gas patterns, reduced $NO_X$ emissions are achieved as well as improved flame quality compared to state-of-the-art radiant wall burner designs.

Figure 3:
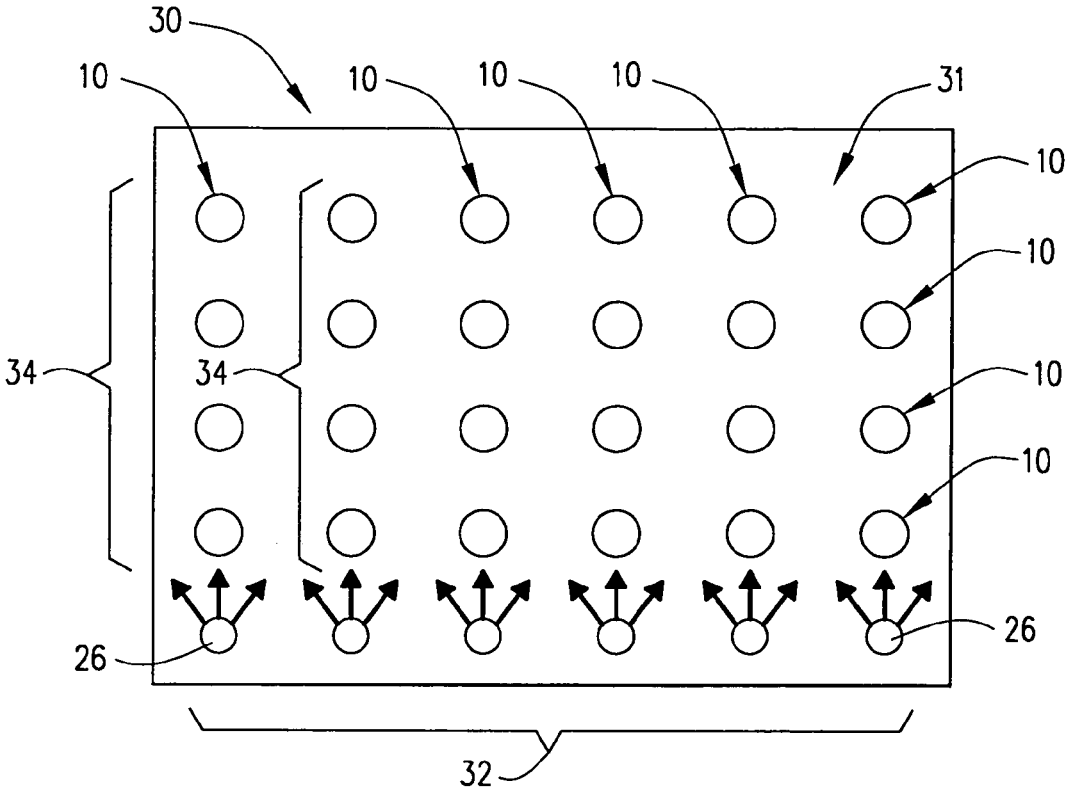
FIG. 3 is a preferred remote staging burner configuration on the wall of a radiant fuel gas fired furnace.

Referring to FIG. 3, an improved radiant wall furnace burner configuration of this invention is illustrated and generally designated by the numeral 30. Rows 32 of multiple radiant wall burners 10 are inserted in a wall 31 of the furnace. The radiant wall burners 10 discharge fuel gas-air mixtures in radial directions across the face of the furnace wall 31. Radiant heat from the wall, as well as thermal radiation from the hot gases, is transferred, for example, to process tubes or other process equipment designed for heat transfer.

Each radiant wall burner 10 is provided a mixture of primary fuel gas and air wherein the flow rate of air is greater than stoichiometry relative to the primary gas. Preferably the rate of air is in the range of from about 105% to about 120% of the stoichiometric flow rate required to completely combust the primary and secondary fuel gas. Secondary fuel gas is discharged into the furnace by way of secondary fuel gas nozzles 26. The burner configuration of FIG. 3 shows the secondary fuel gas nozzles 26 arranged in a row 32 with each secondary fuel gas nozzle positioned below a column 34 of radiant wall burners. The secondary fuel gas nozzles are made to discharge fuel gas in a direction generally toward the radiant wall burners as will be explained in detail below.

Figure 4A:
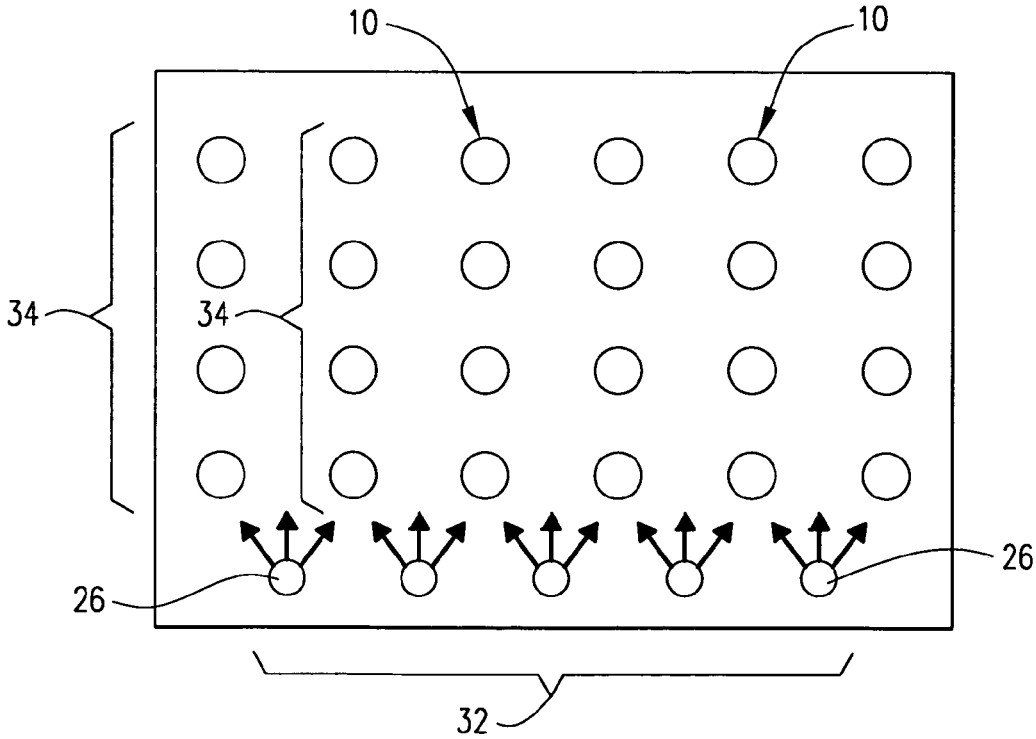
FIGS. 4A–4D illustrate other preferred remote staging configurations on the wall of a radiant fuel gas fired furnace.
Figure 4B:
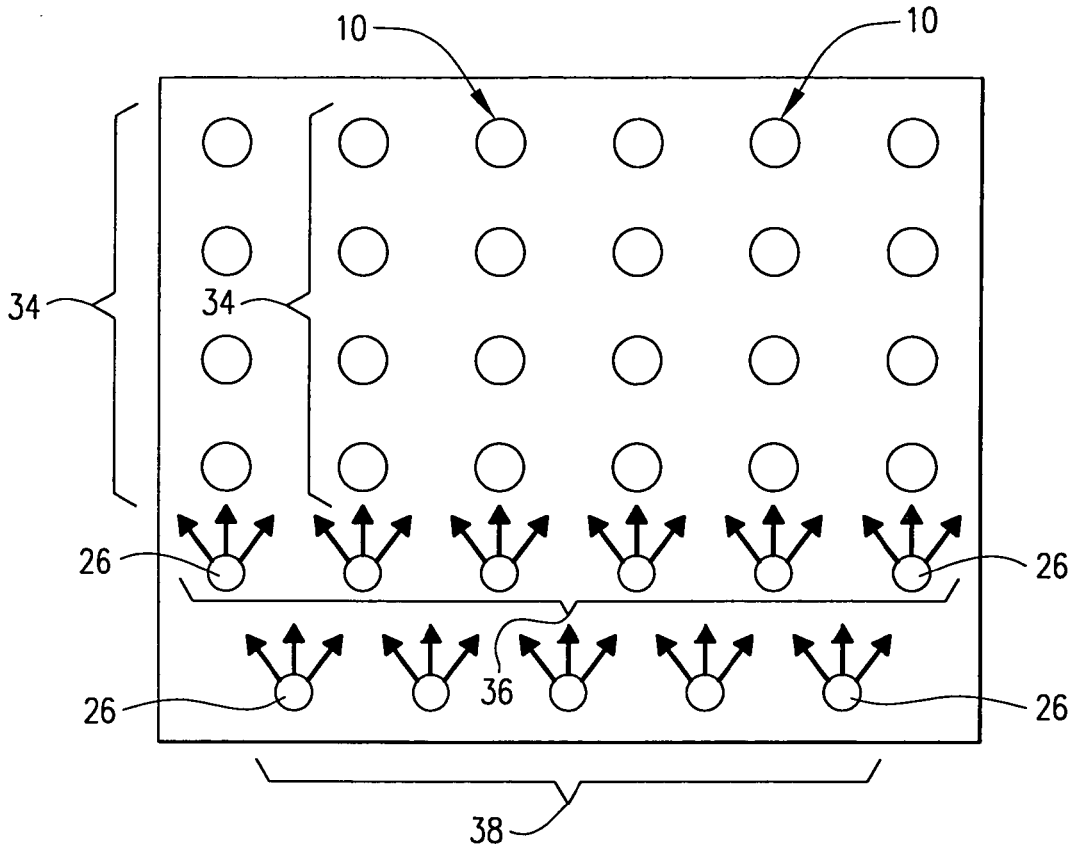
Figure 4C:
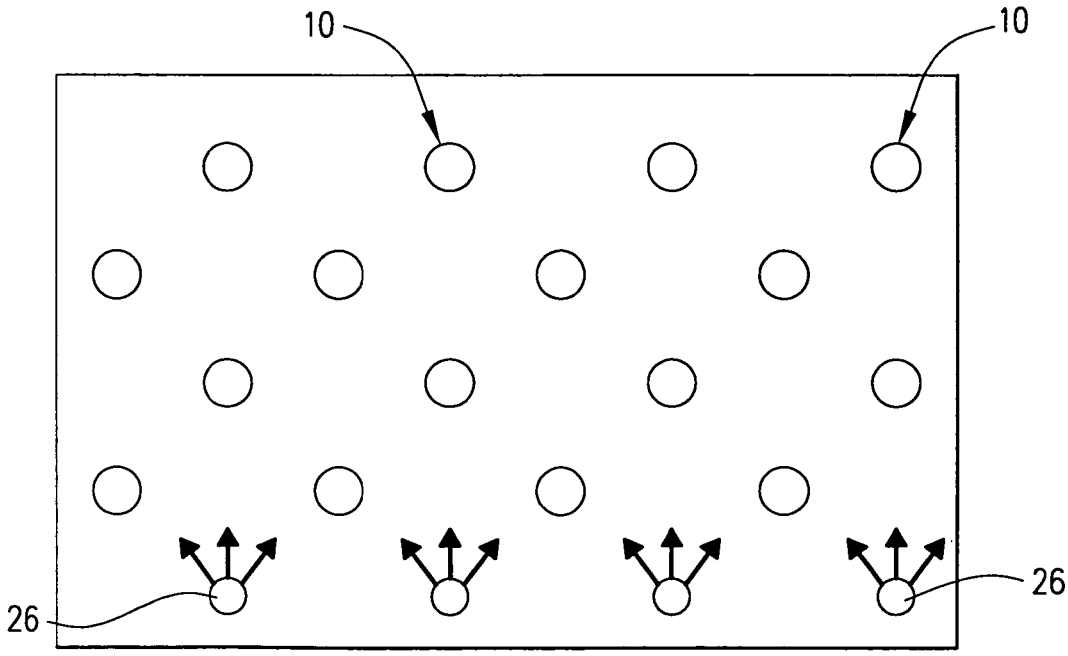
Figure 4D:
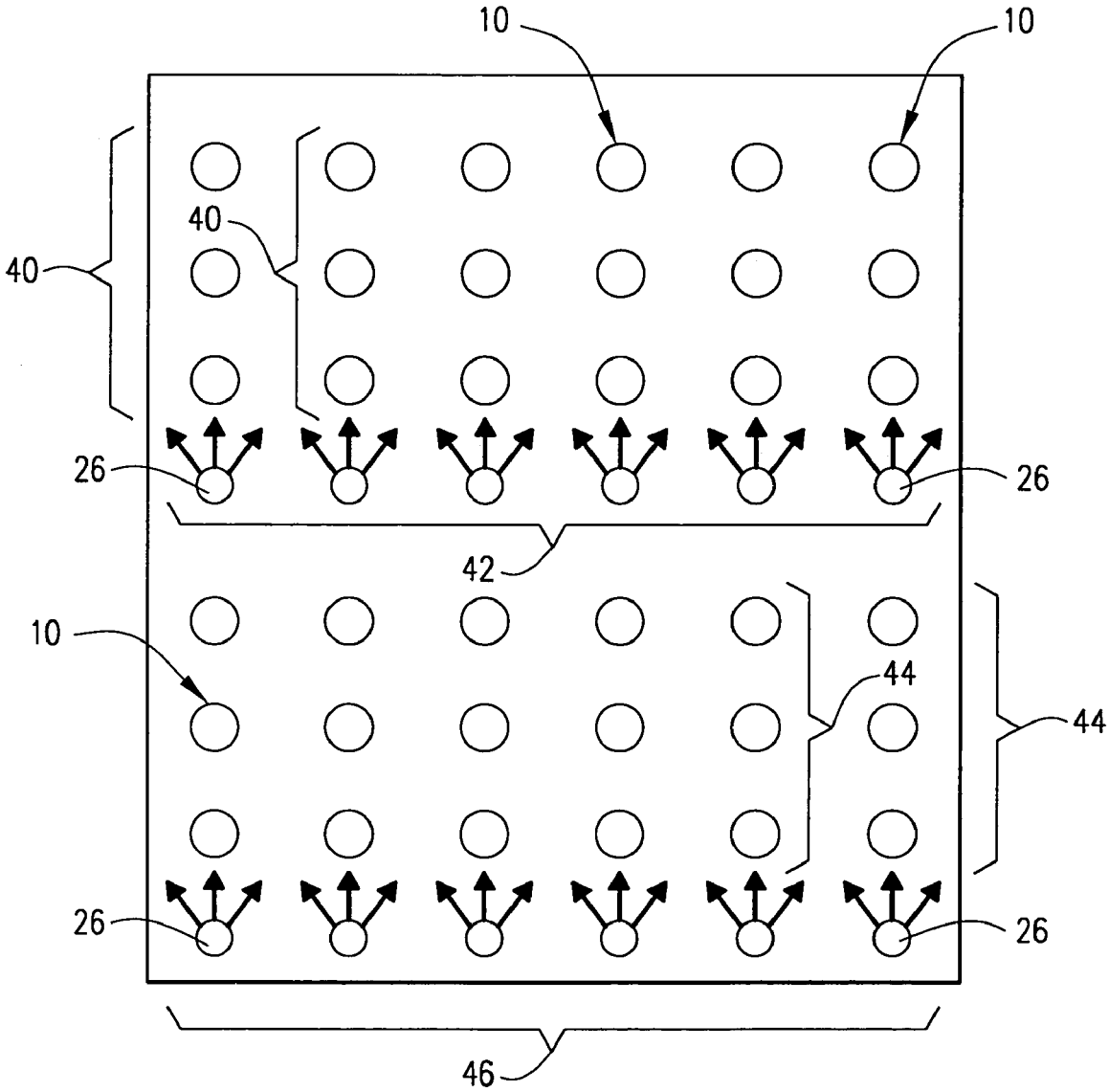

Additional examples of preferred patterns are illustrated in FIGS. 4A–4D. Rows of radiant wall burners 10 can be approximately parallel, the burners 10 can be approximately evenly spaced in columns 34 and the secondary fuel gas nozzles 26 can be positioned in a single row 32 with each nozzle directly below a radiant wall burner 10 in the row above as shown in FIG. 3, or offset as shown in FIG. 4A. As shown in FIG. 4B, in another preferred configuration, the radiant wall burners 10 are in columns approximately parallel, the radiant wall burners 10 are approximately evenly spaced in columns 34 and the secondary fuel gas nozzles 26 positioned below the radiant wall burners 10 are in two rows, an upper row 36 and a lower row 38, wherein each secondary fuel gas nozzle of the upper row 36 is below a burner in the row above and wherein each secondary fuel gas nozzle of the lower row 38 is midway between the horizontal positions of the secondary fuel gas nozzles directly above it in row 36. In yet another preferred configuration shown in FIG. 4C, the radiant wall burners 10 are offset halfway from one another, resulting in a diamond shaped pattern with the secondary fuel gas nozzles 26 located below the radiant wall burners and continuing the pattern. In still another preferred configuration, shown in FIG. 4D, about half of the radiant wall burners 10 are approximately evenly spaced in rows and columns 40 with a row 42 of secondary fuel gas nozzles 26 positioned directly below. The remaining radiant wall burners 10 are below row 42 of secondary fuel gas nozzles and arranged in columns 44. A second row 46 of secondary fuel gas nozzles 26 is located directly below the burner columns 44.

The furnace walls 31 with the radiant wall burners 10 and secondary fuel gas nozzles 26 connected thereto are described above as if the walls are vertical, but it is to be understood that the walls can be at an angle from vertical or the walls can be horizontal.

Figure 5:
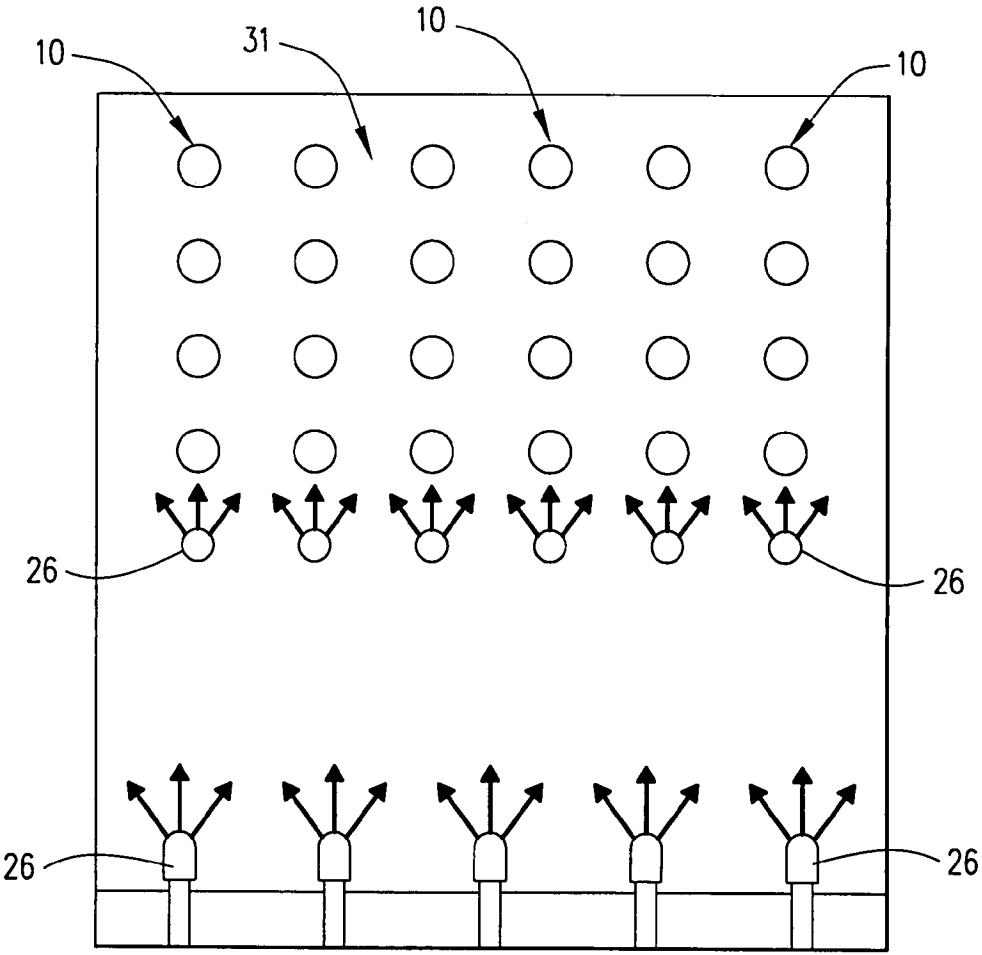
FIGS. 5A–5F illustrate remote staging configurations that include additional secondary fuel gas discharge nozzles on the furnace floor with and without floor burners.
Figure 5A:
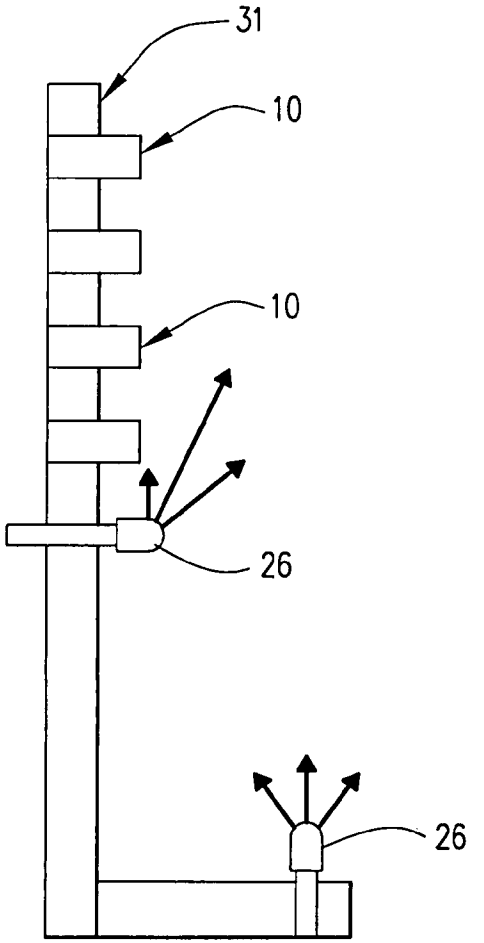
Figure 5A:
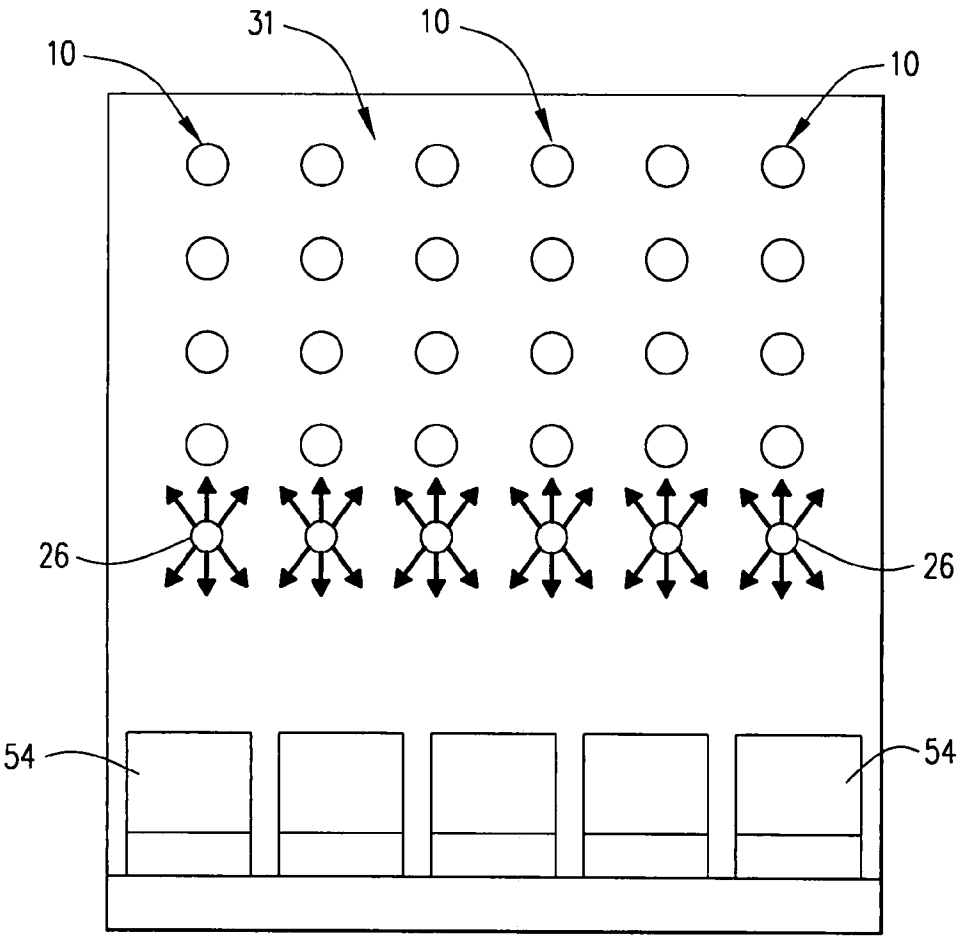
Figure 5B:
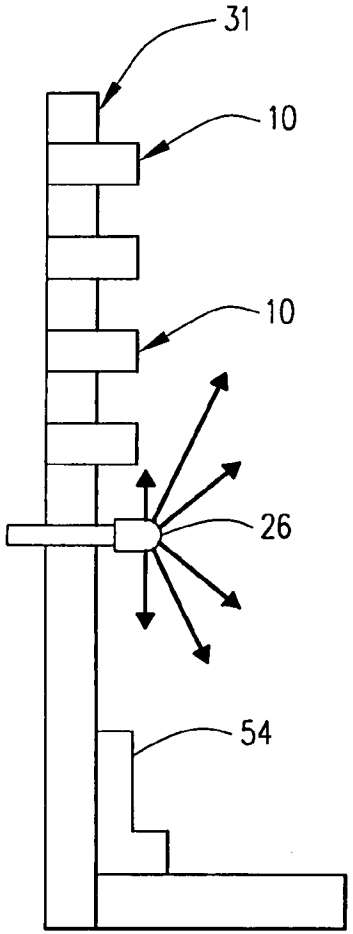

Referring now to FIGS. 5A–5F, alternate arrangements of secondary fuel gas nozzles 26 in accordance with the present invention are shown with and without floor burners 54 (also referred to as hearth burners). Referring to FIGS. 5A and 5B, rows of multiple radiant wall burners 10 are inserted in a wall 31 of a furnace. As previously mentioned, the burners 10 discharge fuel gas-air mixtures in directions across the face of the furnace wall 31. Each radiant wall burner is provided a mixture of primary fuel gas and air wherein the flow rate of air is greater than stoichiometry relative to the primary gas, i.e., in the range of from about 105% to about 120% of the stoichiometric flow rate. Secondary fuel gas is discharged into the furnace by way of secondary fuel gas nozzles 26 disposed below the columns of radiant gas burners 10. In addition, secondary fuel gas nozzles 26 are disposed in the floor of the furnace to provide additional secondary fuel gas that mixes with excess air and furnace flue gases whereby low $NO_x$ levels are produced.

Referring now to FIGS. 5C and 5D, a similar arrangement of radiant wall burners 10 and secondary fuel gas nozzles 26 is illustrated. In addition, floor burners 54 are provided adjacent to the wall 31 that mix fuel gas with an excess of air, and the secondary fuel gas nozzles 26 discharge fuel gas toward both the radiant wall burners and the floor burners whereby the secondary fuel gas readily mixes with furnace flue gases and excess air so that low $NO_X$ levels are produced.

Figure 5E:
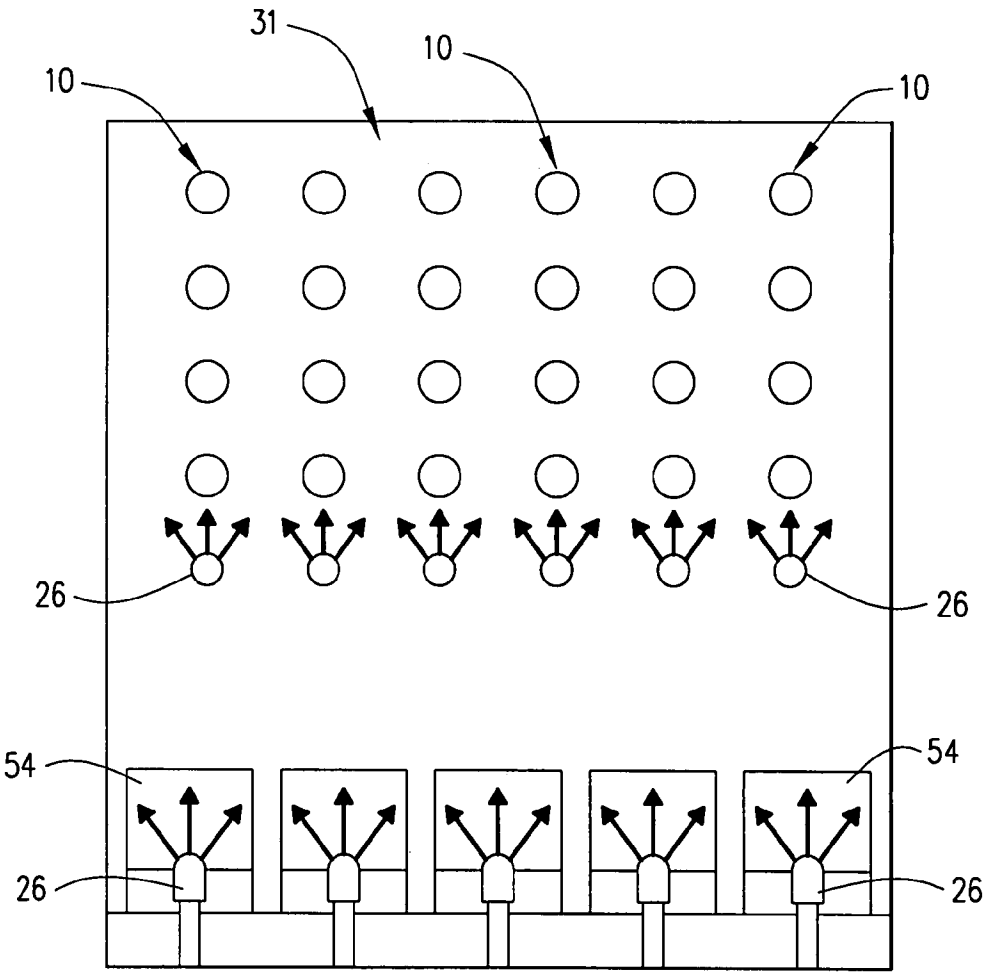
Figure 5F:
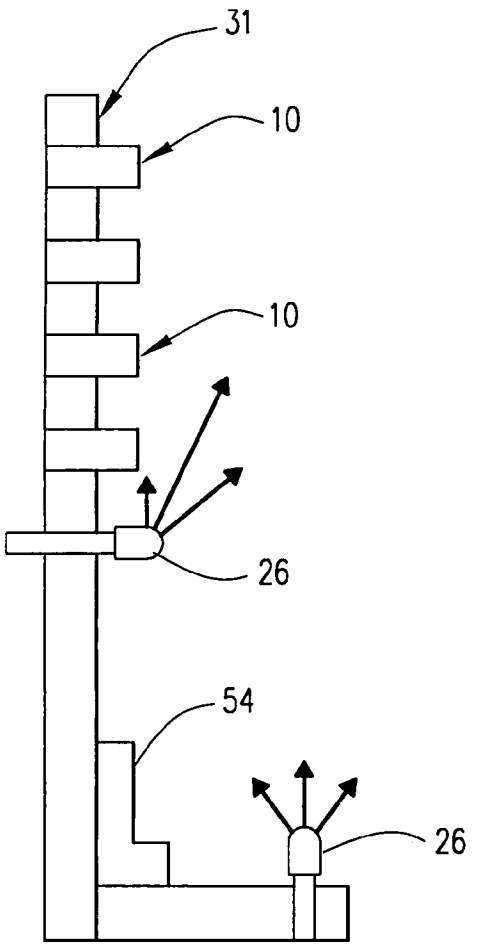

Referring now to FIGS. 5E and 5F, instead of providing secondary fuel gas nozzles 26 that discharge fuel gas toward both the radiant wall burners and the floor burners, additional secondary fuel gas nozzles can be provided in the floor of the furnace to mix with furnace flue gases and the excess air produced by the floor burners whereby low $NO_X$ levels are produced.

Thus, as will now be understood by those skilled in the art, a variety of combinations of radiant wall burners 10 and separate and remote secondary fuel gas nozzles can be utilized in radiant wall gas burner furnaces in accordance with this invention to reduce $NO_X$ levels in furnace flue gases.

Any radiant wall burner can be used in the present inventive configurations and methods. Radiant wall burner designs and operation are well known to those skilled in the art. Examples of radiant wall burners which can be utilized include, but are not limited to, the wall burners described in U.S. Pat. No. 5,180,302 issued on Jan. 19, 1993 to Schwartz et al., and in U.S. patent application Ser. No. 09/949,007, filed Sep. 7, 2001 by Venizelos et al. and entitled "High Capacity/Low NOx Radiant Wall Burner," the disclosures of which are both incorporated herein by reference.

Preferably the total fuel gas-air mixture flowing through the radiant wall burners contains less than about 80% of the total fuel supplied to the combustion zone 28.

Secondary fuel nozzles 26 are inserted through the furnace wall or floor extending about 1 to about 12 inches into the furnace interior. Fuel gas is preferably supplied at a pressure in the range of from about 20 to about 50 psig.

Figure 6:
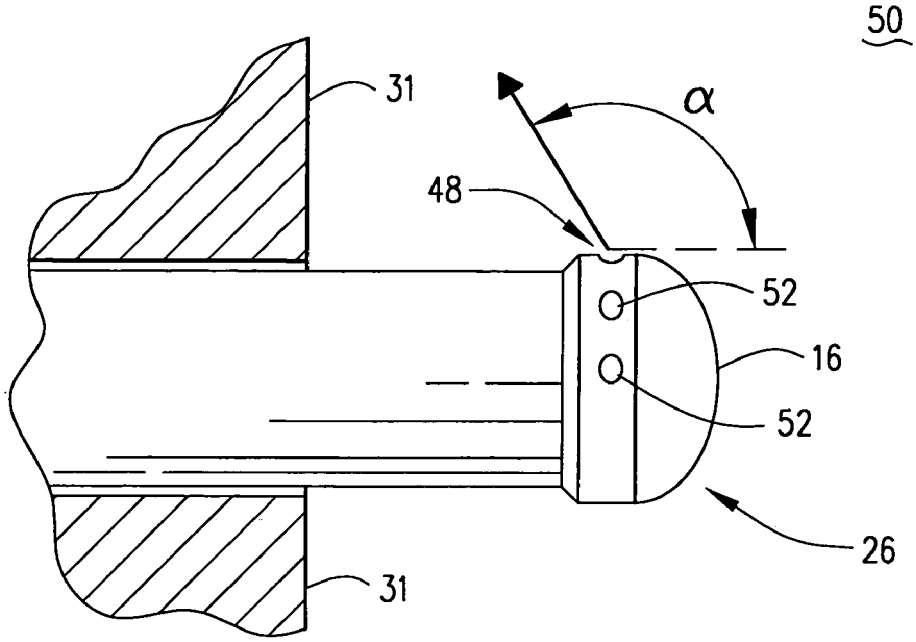
FIG. 6 is a side view of a preferred secondary fuel gas discharge nozzle for use in accordance with this invention.
Figure 7:
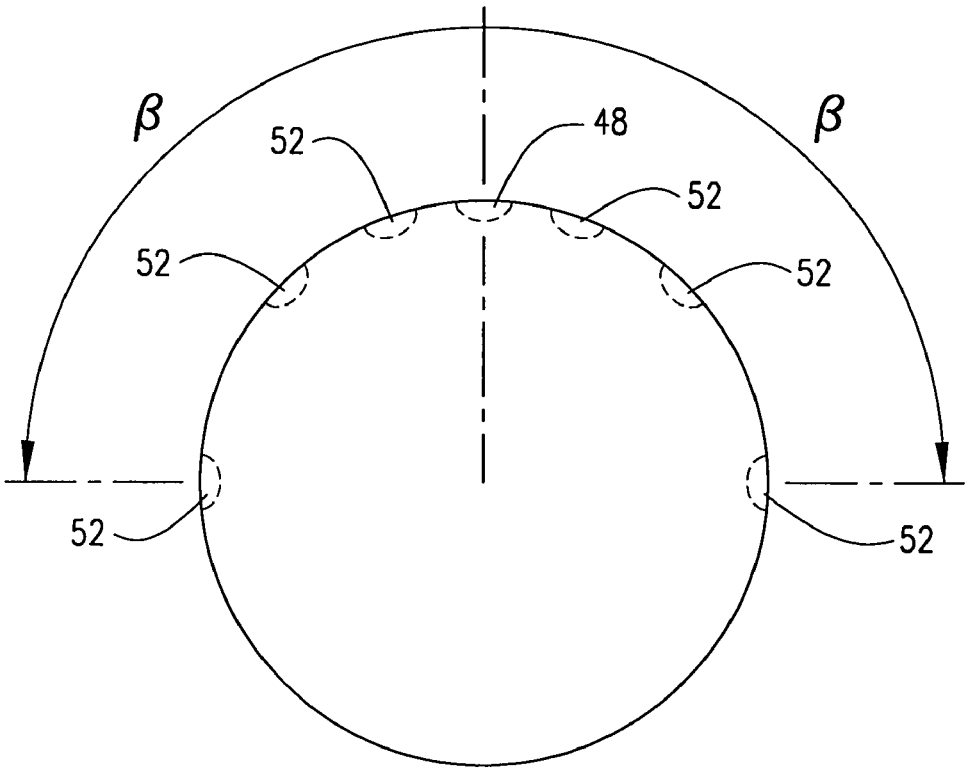
FIG. 7 is a top view of the secondary fuel gas discharge nozzle of FIG. 6.
Figure 9:
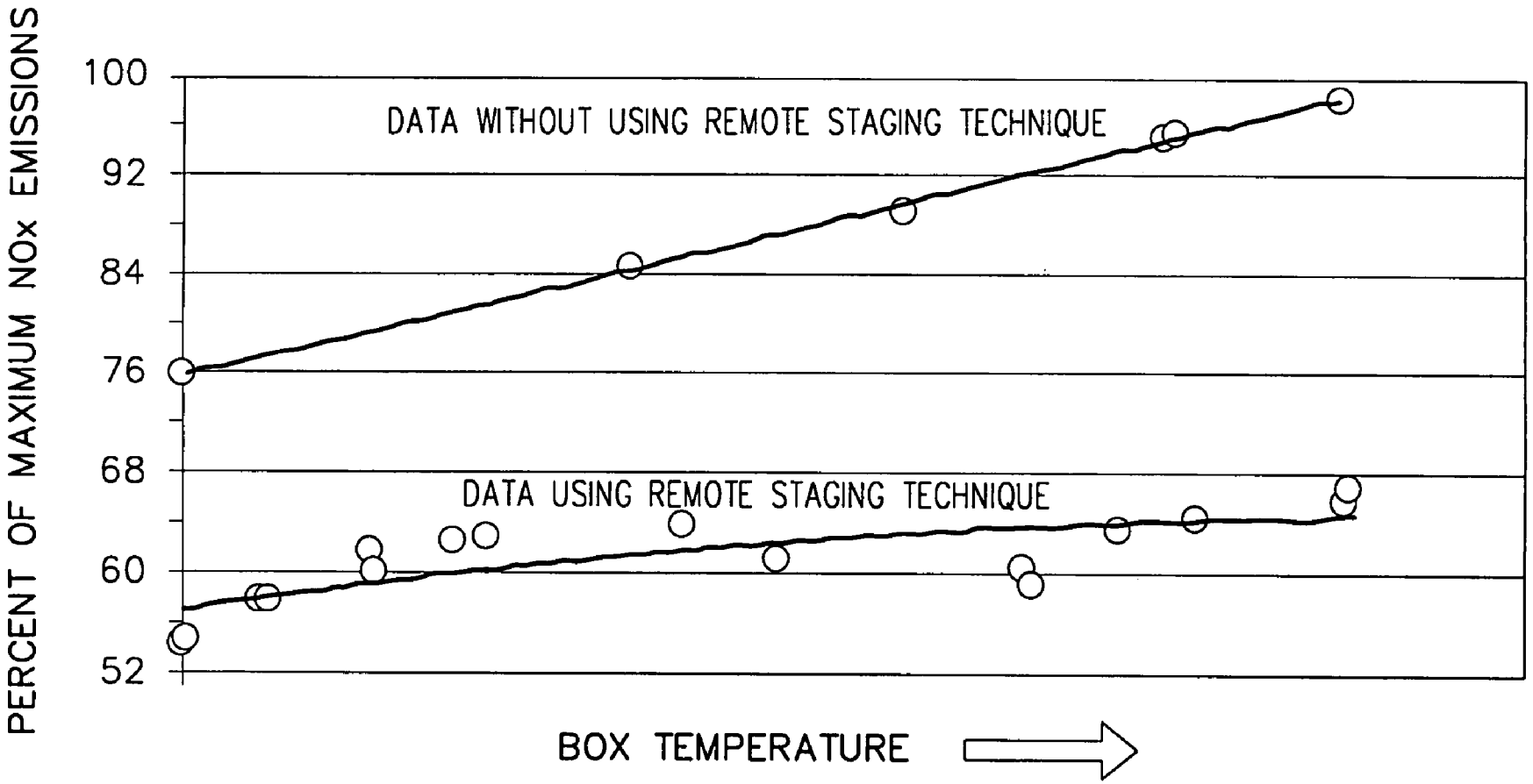

The secondary fuel gas nozzles 26, as illustrated in FIGS. 6 and 7, have tips 16 with secondary fuel gas delivery openings 48 therein for directing the flow of secondary fuel gas into the furnace space 50. The openings 48 direct secondary fuel towards and away from a wall of the furnace at an angle $\alpha$ in the range of about 60° to about 120° from the longitudinal axis.

In a preferred embodiment, the secondary fuel gas nozzle tips 16 include additional side delivery openings 52 for discharging secondary fuel gas in various directions over angles $\beta$ in the range of from about 10° to about 180° from both sides of a vertical plane through the longitudinal axis, and more preferably at an angle in the range of about 20° to about 150°. As will be understood by those skilled in the art, the secondary fuel gas nozzle tips can include multiple openings 48 and 52 positioned to discharge fuel gas toward and/or away from the furnace wall depending on the radiant wall and other burner configurations used and other factors.

A method of the present invention for burning fuel gas and air in a radiant wall furnace whereby flue gases of reduced $NO_x$ content are formed comprises the following steps:

(a) providing a fuel lean mixture of fuel gas and air to individual radiant wall burners arranged in rows along a wall of the furnace;

(b) causing the mixture of fuel gas and air to flow radially outward from each radiant wall burner across the wall of the furnace whereby the mixture contains excess air and is burned at a relatively low temperature and flue gases having low $NO_X$ content are formed therefrom; and (c) providing secondary fuel gas to remote and separate secondary fuel gas nozzles located whereby the secondary fuel gas mixes with flue gases in the furnace and combusts with excess air from the radiant wall burners, lowers the temperature of the burning fuel gas and reduces the formation of $NO_X$.

In order to further illustrate the furnace burner configuration and method of the present invention, the following example is given.

EXAMPLE

A comparison was made of the $NO_X$ emissions using radiant wall burners with and without remote staging. The test furnace utilized an array of 12 radiant wall burners arranged in 3 columns of 4 burners each. The burners were spaced 50 inches apart in each column and the columns were spaced 36.5 inches apart. The furnace was operated while supplying secondary gas to the center of the radiant wall burners and the $NO_X$ in the furnace off gas was measured over time. The furnace was then operated after removing secondary gas from the burner centers and conducting the secondary gas to remote nozzles located adjacent to the columns of radiant wall burners.

FIG. 8 is a plot comparing $NO_X$ emissions from the furnace with and without the remote staging configuration. The data demonstrate that $NO_X$ emissions are reduced by 50% using the remote staging configuration.

Thus, the present invention is well adapted to attain the objects and advantages mentioned as well as those that are inherent therein. While numerous changes may be made by those skilled in the art, such changes are encompassed within the spirit of this invention as defined by the appended claims.

What is claimed is:

1. In a radiant wall furnace having walls, a floor and a burner configuration utilizing rows or columns or both of multiple radiant wall burners having longitudinal axes substantially perpendicular and attached to a wall of the furnace, each directing a combustible fuel gas-excess air mixture in a direction radially outward relative to the longitudinal axis thereof into a combustion zone adjacent a burner tile, the improvement which comprises:

an array of secondary fuel gas nozzles for injecting secondary fuel gas into the furnace that mixes with flue gases in the furnace and combusts with excess air, lowers the temperature of the burning fuel gas and reduces the formation of $NO_X$, and means for introducing secondary fuel gas into said secondary fuel gas nozzles, said secondary fuel gas nozzles being located separate and remote from the radiant wall burners such that the secondary fuel gas is not encapsulated or surrounded by the fuel gas-air mixture from the radiant wall burners thereby allowing secondary fuel gas to mix with flue gases in the furnace prior to mixing with the fuel gas-air mixture.

2. The improved furnace burner configuration of claim 1 wherein the array of secondary fuel gas nozzles is positioned in at least one row adjacent to the rows of radiant wall burners.

3. The improved furnace burner configuration of claim 1 wherein the secondary fuel gas nozzles direct secondary fuel gas to a location in the furnace on the opposite side of the combustion zone from the radiant wall burners.

4. The improved furnace burner configuration of claim 1 wherein the rows or columns or both of radiant wall burners are approximately parallel, the radiant wall burners are approximately evenly spaced and the secondary fuel gas nozzles are in one or two rows with each secondary fuel gas nozzle positioned adjacent to a radiant wall burner or offset from a radiant wall burner.

5. The improved furnace burner configuration of claim 1 wherein the rows of radiant wall burners are approximately parallel, the radiant wall burners are relatively evenly spaced in columns and the secondary fuel gas nozzles are in a middle first row and an outside second row wherein each secondary fuel gas nozzle of the middle first row is adjacent to a radiant wall burner and wherein each secondary fuel gas nozzle of the outside second row is offset from a radiant wall burner.

6. The improved burner configuration of claim 1 wherein the radiant wall burner rows are approximately parallel and each row is offset one-half spacing from the regular spacing of adjacent rows.

7. The improved burner configuration of claim 1 wherein one or more rows of secondary fuel gas nozzles are located adjacent to the rows of radiant wall burners and an additional one or more rows of secondary fuel gas nozzles are located midway within the rows of radiant wall burners.

8. The improved burner configuration of claim 1 wherein each secondary fuel gas nozzle has a tip having at least one fuel delivery opening therein to eject fuel gas toward or away from the wall of the furnace at an angle $\alpha$ relative to the axis of the secondary fuel gas nozzle.

9. The improved burner configuration of claim 8 wherein the angle $\alpha$ is in a range of about 60° to about 120° from the axis.

10. The improved burner configuration of claim 1 wherein each secondary fuel gas nozzle has a tip having one or multiple fuel delivery openings positioned to eject fuel gas toward or away or both from the furnace wall.

11. The improved furnace burner configuration of claim 10 wherein each secondary fuel gas nozzle tip has multiple fuel delivery openings therein positioned within an outward angle $\beta$ in a range of from about 10° to about 180° from both sides of a vertical plane through the longitudinal axis of the secondary fuel gas nozzle.

12. The improved furnace burner configuration of claim 1 wherein the furnace further comprises an array of secondary fuel gas nozzles located on the floor of the furnace.

13. The improved furnace burner configuration of claim 1 wherein the furnace includes floor burners positioned adjacent to the wall having radiant wall burners attached thereto.

14. The improved furnace burner configuration of claim 12 wherein the furnace includes floor burners positioned adjacent to the wall having radiant wall burners attached thereto and the secondary fuel gas nozzles each have tips having multiple fuel delivery openings positioned to eject fuel gas toward or away from the wall in multiple directions.

15. A method of burning fuel gas and air in a radiant wall furnace whereby flue gases of reduced $NO_X$ content are formed comprising the steps of:

(a) providing a fuel lean mixture of fuel gas and air to individual radiant wall burners arranged in rows along a wall of the furnace;

(b) causing the mixture of fuel gas and air to flow radially outward from each radiant wall burner across the wall of the furnace whereby the mixture contains excess air and is burned at a relatively low temperature and flue gases having low $NO_x$ content are formed therefrom; and (c) providing secondary fuel gas from secondary fuel gas nozzles for mixing with flue gases in the furnace and combusting with excess air from the radiant wall burners, lowering the temperature of the burning fuel gas and reducing the formation of $NO_X$, said secondary fuel gas nozzles being located separate and remote from said radiant wall burners such that the secondary fuel gas is not encapsulated or surrounded by the mixture of fuel gas and air from said burners thereby allowing secondary fuel gas to mix with flue gases in the furnace prior to mixing with said mixture of fuel gas and air from said burners.

16. The method of claim 15 wherein the secondary fuel gas is discharged from secondary fuel gas nozzles in at least one row adjacent to the rows of radiant wall burners.

17. The method of claim 15 wherein the secondary fuel gas nozzles direct secondary fuel gas to a location in the furnace on the opposite side of the combustion zone from the radiant wall burners.

18. The method of claim 15 wherein the rows of radiant wall burners are approximately parallel, the radiant wall burners are approximately evenly spaced in columns and the secondary fuel gas nozzles are in one or two rows with each secondary fuel gas nozzle positioned adjacent to a radiant wall burner or offset from a radiant wall burner.

19. The method of claim 15 wherein the rows of radiant wall burners are approximately parallel, the radiant wall burners are approximately evenly spaced in columns and the secondary fuel gas nozzles are in a middle first row and an outside second row wherein each secondary fuel gas nozzle of the middle first row is adjacent to a radiant wall burner and wherein each secondary fuel gas nozzle of the outside second row is offset from a radiant wall burner.

20. The method of claim 15 wherein the radiant wall burner rows are approximately parallel and each row is offset one-half spacing from the regular spacing of adjacent rows.

21. The method of claim 15 wherein one or more rows of secondary fuel gas nozzles are located adjacent to the rows of radiant wall burners and an additional one or more rows of secondary fuel gas nozzles are located midway within the rows of radiant wall burners.

22. The method of claim 15 wherein each secondary fuel gas nozzle has a tip having at least one fuel delivery opening therein to eject fuel gas toward or away from the wall of the furnace at an angle $\alpha$ relative to the axis of the secondary fuel gas nozzle.

23. The method of claim 22 wherein the angle $\alpha$ is in a range of about 60° to about 120° from the axis.

24. The method of claim 15 wherein each secondary fuel gas nozzle has a tip having one or multiple fuel delivery openings positioned to eject fuel gas toward or away or both from the furnace wall.

25. The method of claim 24 wherein each secondary fuel gas nozzle tip has multiple fuel delivery openings therein positioned within an outward angle $\beta$ in a range of from about 10° to about 180° from both sides of a vertical plane through the longitudinal axis of the fuel gas nozzle.

26. The method of claim 15 wherein the furnace further comprises an array of secondary fuel gas nozzles located on the floor of the furnace.

27. The method of claim 15 wherein the furnace includes floor burners positioned adjacent to the wall having radiant wall burners attached thereto.

28. The method of claim 26 wherein the furnace includes floor burners positioned adjacent to the wall having radiant wall burners attached thereto and the secondary fuel gas nozzles each have tips having multiple fuel delivery openings positioned to eject fuel gas toward or away from the wall in multiple directions.

* * * * *